US010625142B2

(12) United States Patent
Takahisa

(10) Patent No.: US 10,625,142 B2
(45) Date of Patent: Apr. 21, 2020

(54) BALL SKATE SOLE STRUCTURE, SKATING SHOE, SANDAL STRUCTURE, AND SKATEBOARD

(71) Applicant: ABILITIER INC., Tokyo (JP)

(72) Inventor: Tsutomu Takahisa, Tokyo (JP)

(73) Assignee: ABILITIER INC., Tokyo (JP)

( * ) Notice: Subject to any disclaimer, the term of this patent is extended or adjusted under 35 U.S.C. 154(b) by 0 days.

(21) Appl. No.: 16/094,349

(22) PCT Filed: Apr. 20, 2017

(86) PCT No.: PCT/JP2017/015842
§ 371 (c)(1),
(2) Date: Oct. 17, 2018

(87) PCT Pub. No.: WO2017/183681
PCT Pub. Date: Oct. 26, 2017

(65) Prior Publication Data

US 2019/0118070 A1 Apr. 25, 2019

(30) Foreign Application Priority Data

Apr. 21, 2016 (JP) ..... 2016-085410

(51) Int. Cl.
*A63C 17/00* (2006.01)
*A63C 17/24* (2006.01)
*A63C 17/14* (2006.01)

(52) U.S. Cl.
CPC ..... *A63C 17/24* (2013.01); *A63C 17/14* (2013.01)

(58) Field of Classification Search
CPC ..... A63C 17/014; A63C 17/24; A63C 17/01; A63C 17/006
See application file for complete search history.

(56) References Cited

U.S. PATENT DOCUMENTS 1,616,442 A 2/1927 De Fastenburg et al.
3,379,454 A * 4/1968 Woodman ..... B60B 33/08 280/87.042
3,522,951 A * 8/1970 Tyson ..... A63C 5/035 280/842
4,328,627 A 5/1982 Sanders
(Continued)

FOREIGN PATENT DOCUMENTS

JP 50084/1992 4/1992
JP 8-224334 9/1996
(Continued)

OTHER PUBLICATIONS

Official Communication issued in International Bureau of WIPO Patent Application No. PCT/JP2017/015842, dated Aug. 8, 2017.

*Primary Examiner* — Hau V Phan
(74) *Attorney, Agent, or Firm* — Greenblum & Bernstein, P.L.C.

(57) ABSTRACT

Provided is a ball skate sole structure which can be customized for each individual or each sport. This ball skate sole structure includes: a base plate having a plurality of first holes and a plurality of second holes; at least one ball roller member, the at least one ball roller member being disposed in the first hole selected from among the plurality of first holes; and at least one brake member, the at least one brake member being disposed in the second hole selected from among the plurality of second holes.

19 Claims, 7 Drawing Sheets

(56) References Cited

U.S. PATENT DOCUMENTS 4,572,529 A * 2/1986 Thomas ..... A63C 17/24 280/11.226
4,691,453 A * 9/1987 Tifre ..... A43B 5/12 280/843
5,207,454 A * 5/1993 Blankenburg ..... A63C 17/006 280/11.226
5,409,265 A * 4/1995 Douglass ..... A63C 17/01 280/11.27
5,947,486 A 9/1999 Zell
6,293,565 B1 * 9/2001 Bouchard ..... A63C 17/01 280/11.222
6,401,900 B1 * 6/2002 Masciarelli, Jr. ..... B65G 13/10 193/35 MD
6,491,308 B1 12/2002 Bakx
7,063,335 B1 * 6/2006 Galeev ..... A63C 17/064 280/11.204
8,146,929 B1 * 4/2012 Johnson ..... A63C 17/24 280/87.042
8,226,096 B2 * 7/2012 Reyes, Jr. ..... A63C 17/016 280/11.226
8,864,150 B2 * 10/2014 Loveland ..... B62K 9/00 280/200
8,910,958 B2 * 12/2014 Smith ..... A63C 17/014 280/14.22
2006/0214394 A1 9/2006 Seid

FOREIGN PATENT DOCUMENTS

JP 10-15145 1/1998
JP 2001-522671 11/2001
WO 80/01234 6/1980

* cited by examiner

[Figure 1]
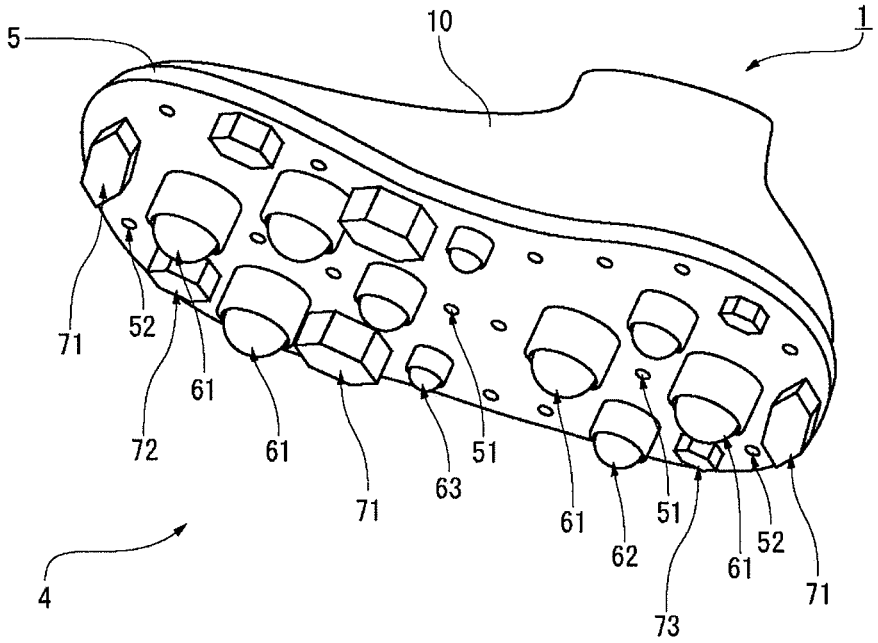
[Figure 2]
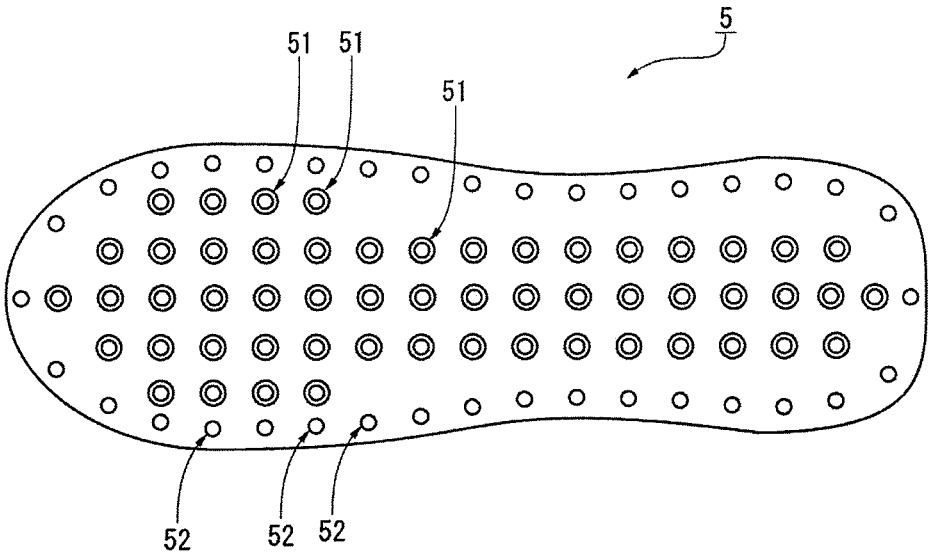

[Figure 3]
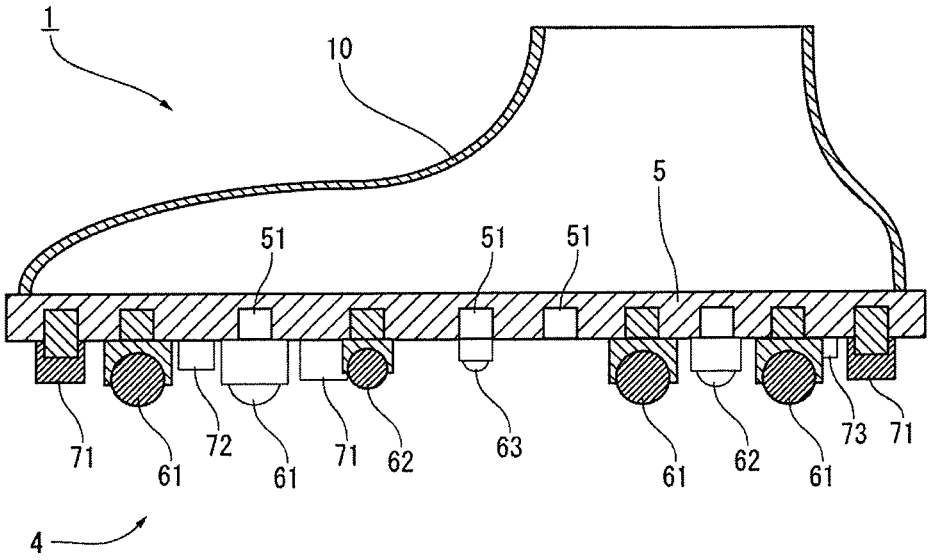
[Figure 4]
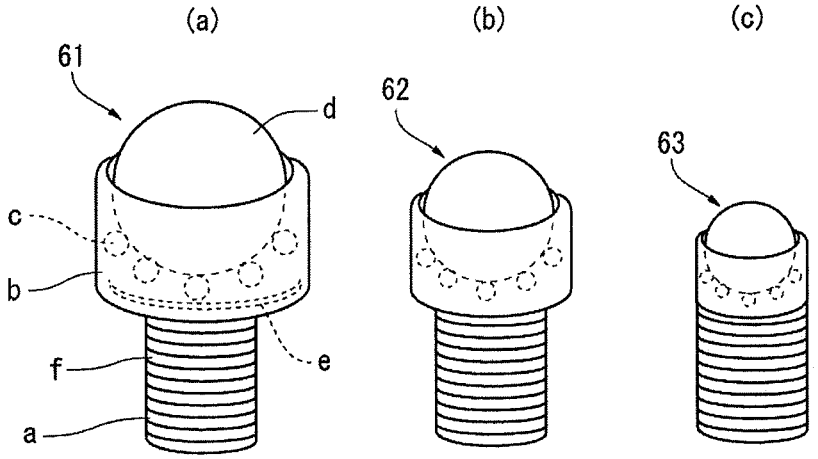

[Figure 5]
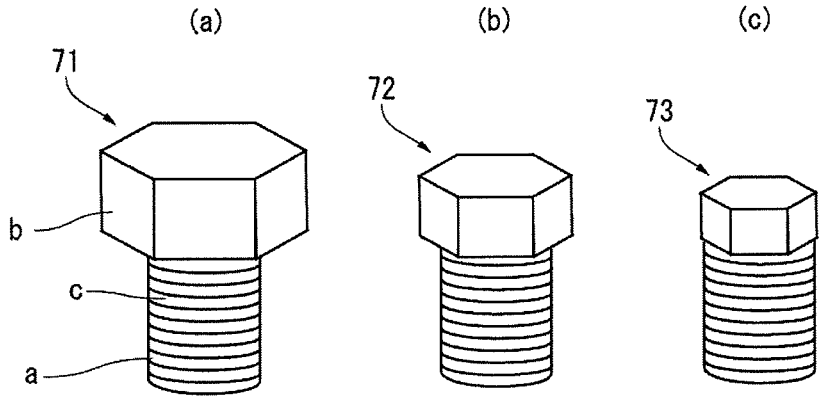
[Figure 6]
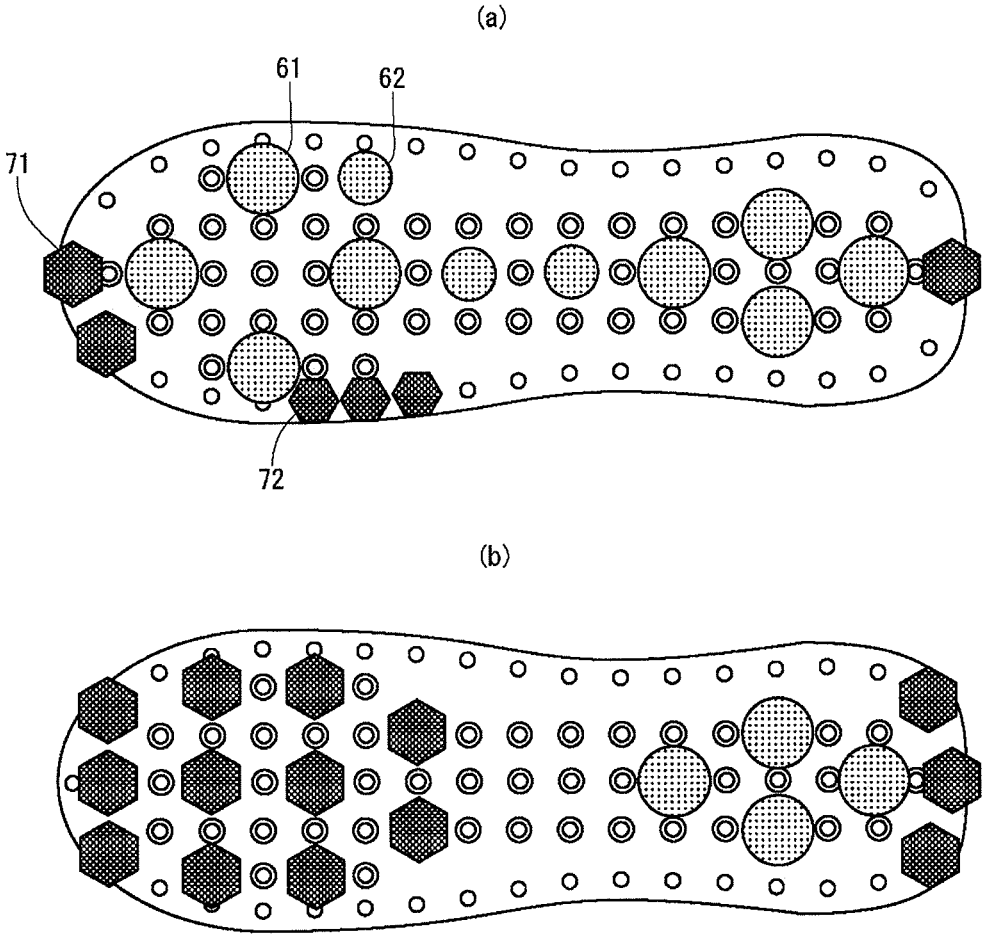

[Figure 7]
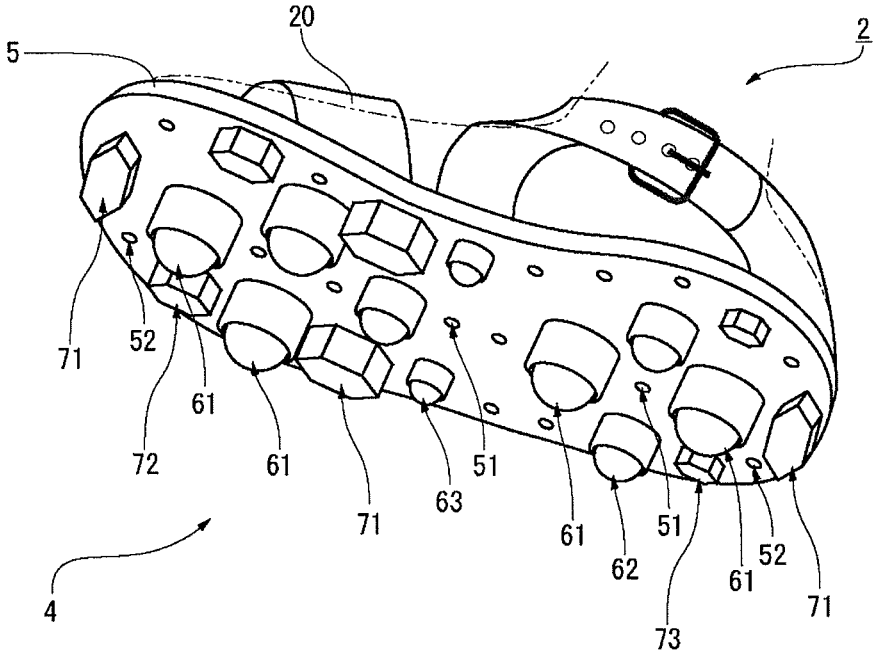
[Figure 8]
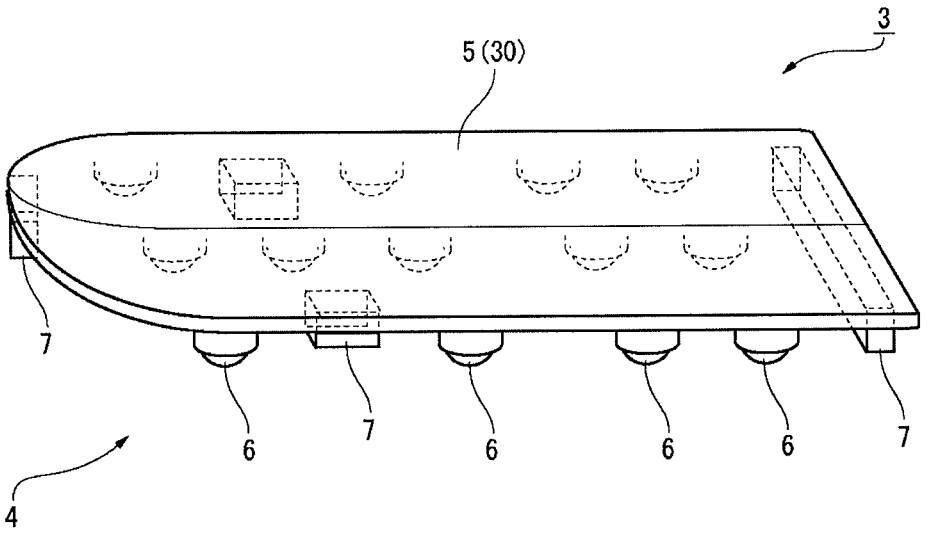

[Figure 9]
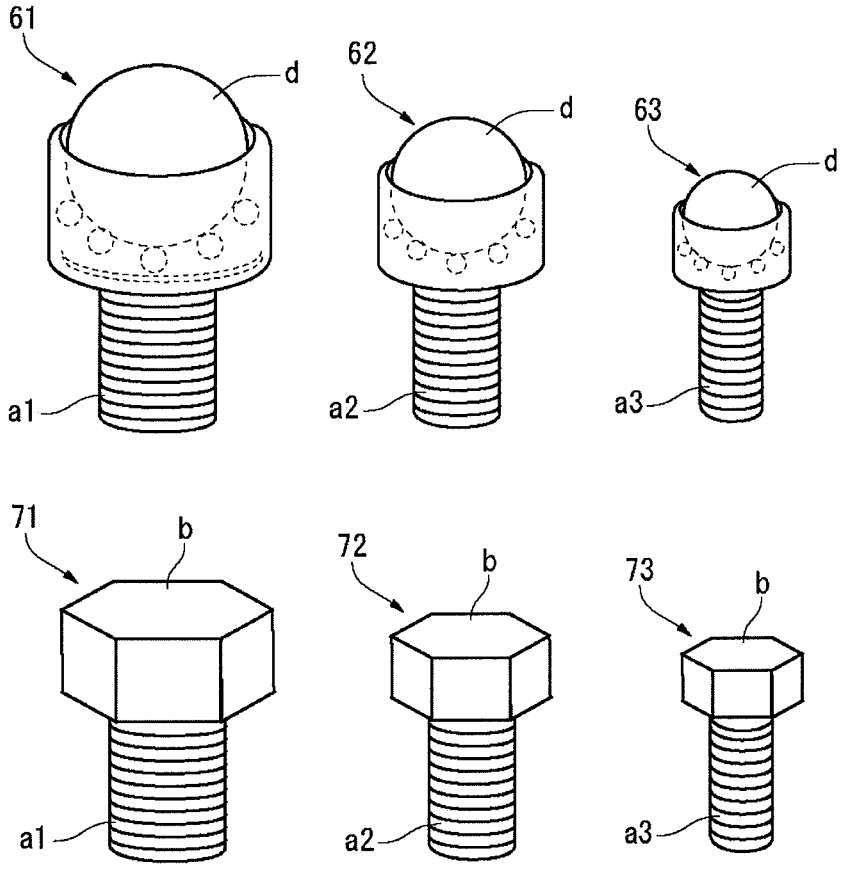
[Figure 10]
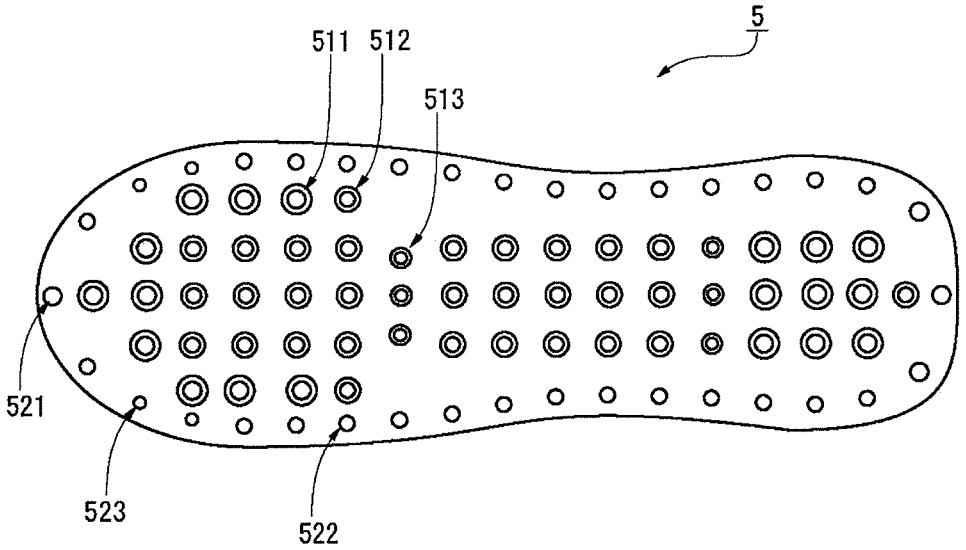

[Figure 11]
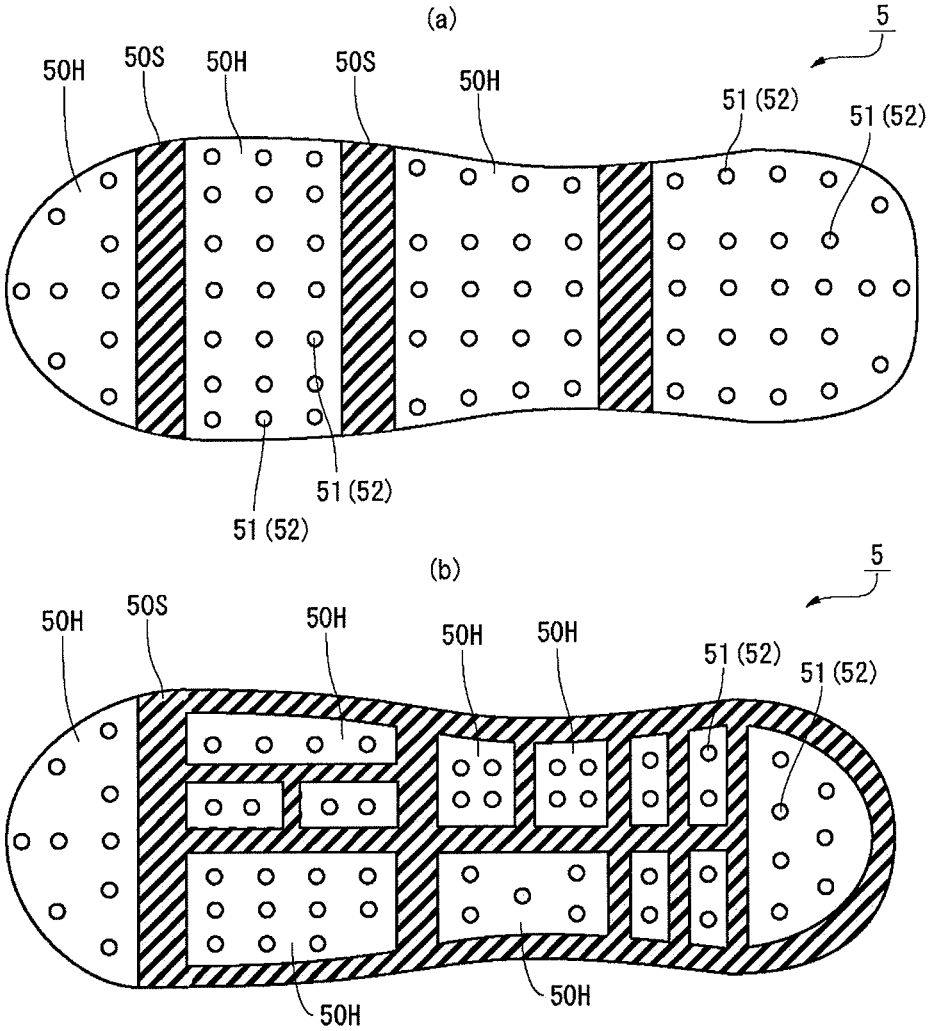

[Figure 12]
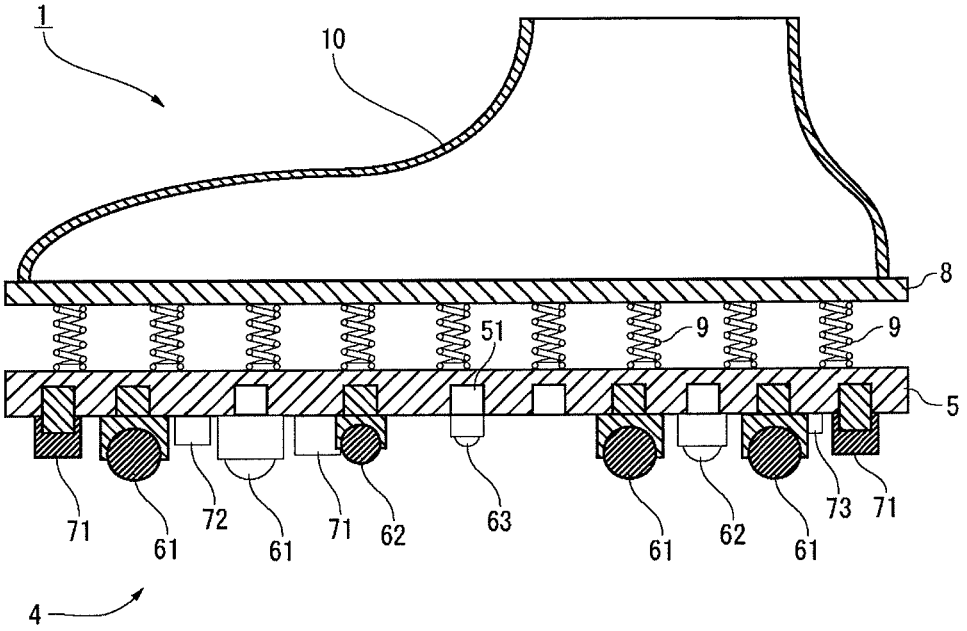
[Figure 13]
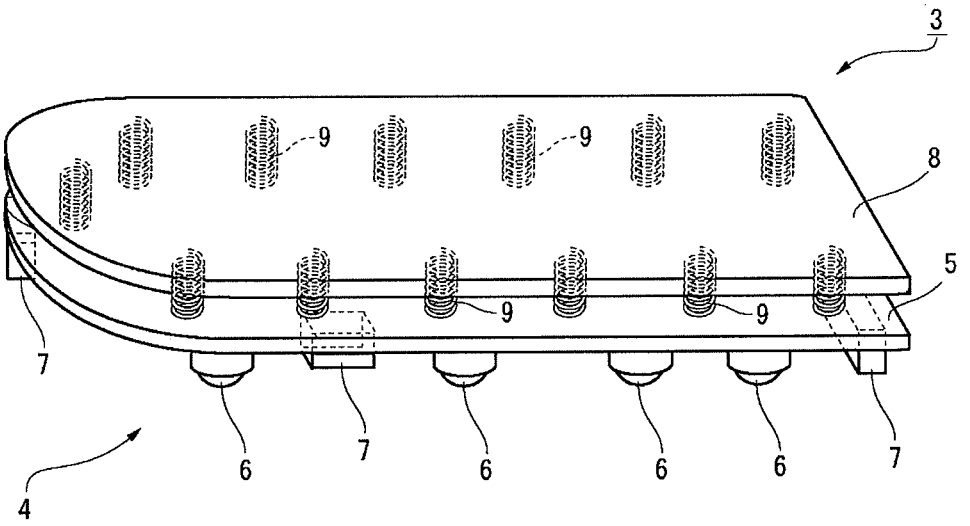

BALL SKATE SOLE STRUCTURE, SKATING SHOE, SANDAL STRUCTURE, AND SKATEBOARD

TECHNICAL FIELD

The present invention relates to a ball skate sole structure, a skating shoe, a sandal structure, and a skateboard each having a skate edge part using a sphere.

BACKGROUND ART

Conventionally, many roller skates include wheel-like rollers, and are configured to advance in the rotation direction of the rollers. This conventional type roller skate only advances in the rotation direction of the roller, and therefore needs to change the direction by twisting a body. Therefore, there is a problem that the direction change is difficult for a beginner.

Patent Literature 1 proposes a roller skate in which a plurality of ball transfers as rollers using spheres as rotors are mounted on a sole, a resistor is provided near a toe of the sole, and resistors are provided near both sides of a heel portion. With such a configuration, even a beginner can easily change the direction.

CITATION LIST

Patent Literature

Patent Literature 1: Japanese Patent Laid-Open No. 10-15145

SUMMARY OF INVENTION

Technical Problem

However, in the above roller skate of Patent Literature 1, the arrangement of the rollers and the resistors is fixed, and therefore the roller skate cannot be customized for each individual or each sport.

An object of the present invention is to provide a ball skate sole structure capable of being customized for each individual or each sport.

Solution to Problem

In order to achieve the object, a ball skate sole structure of the present invention includes: a base plate having a plurality of first holes and a plurality of second holes; at least one ball roller member, the at least one ball roller member being disposed in the first hole selected from among the plurality of first holes; and at least one brake member, the at least one brake member being disposed in the second hole selected from among the plurality of second holes.

Advantageous Effects of Invention

Thus, the ball skate sole structure of the present invention includes: the base plate having the plurality of first holes and the plurality of second holes; the at least one ball roller member being disposed in the first hole selected from among the plurality of first holes; and the at least one brake member being disposed in the second hole selected from among the plurality of second holes. The ball skate sole structure has such a configuration, and therefore the arrangement of the ball roller members and the brake members are suitably selected, so that it is possible to customize the ball skate sole structure for each individual or each sport.

BRIEF DESCRIPTION OF DRAWINGS

FIG. 1 is a perspective view as viewed from a lower surface of a skating shoe of Embodiment 1.

FIG. 2 is a bottom view of the skating shoe of Embodiment 1.

FIG. 3 is a sectional view of the skating shoe of Embodiment 1.

FIG. 4 is a perspective view of ball roller members. (a) illustrates a large-size ball roller member, (b) illustrates a medium-size ball roller member, and (c) illustrates a small-size ball roller member.

FIG. 5 is a perspective view of brake members. (a) illustrates a large-size brake member, (b) illustrates a medium-size brake member, and (c) illustrates a small-size brake member.

FIG. 6 is an explanatory diagram illustrating an example of arrangement patterns of the ball roller members and the brake members. (a) illustrates arrangement for an offensive player, and (b) illustrates arrangement for a defensive player.

FIG. 7 is a perspective view as viewed from a lower surface of a sandal structure of Embodiment 2.

FIG. 8 is a perspective view as viewed from a lower surface of a skateboard of Embodiment 3.

FIG. 9 is a perspective view of ball roller members and brake members of Embodiment 4.

FIG. 10 is a bottom view of a skating shoe of Embodiment 4.

FIG. 11 is a bottom view of a skating shoe of Embodiment 5.

FIG. 12 is a sectional view of a skating shoe of Embodiment 6.

FIG. 13 is a perspective view of a skateboard of Embodiment 6.

DESCRIPTION OF EMBODIMENTS

Hereinafter, embodiments of the present invention will be described with reference to the drawings. In the following description, a skating shoe 1, a sandal structure, and a skateboard each including a ball skate sole structure will be described in Embodiment 1, Embodiment 2, and Embodiment 3, respectively.

Embodiment 1

(Configuration)

First, a configuration of a skating shoe 1 including a ball skate sole structure 4 of the present invention will be described with reference to FIG. 1 to FIG. 3. As illustrated in FIG. 1, the skating shoe 1 includes the ball skate sole structure 4, an upper part 10 that stores a foot, as a whole.

The upper part 10 plays a role of protecting a foot from a change in whether of the outside (warmth, coldness, rain, or the like), or impact, and always closely attached to the foot so as not to cause the foot to spring in walking. The upper part 10 is formed of a raw material having a hygroscopic property and an elastic property.

The ball skate sole structure 4 of this embodiment includes a base plate 5 having a plurality of first holes 51, . . . , and a plurality of second holes 52, . . . , at least one of ball roller members 61 to 63, the at least one of the ball roller members 61 to 63 being disposed in the first hole 51 selected from among the plurality of first holes 51, . . . ; and at least one of brake members 71 to 73, the at least one of the brake members 71 to 73 being disposed in the second hole 52 selected from among the plurality of second holes 52, . . . .

The base plate 5 is formed in a plate shape by synthetic resin or the like, and has the first holes 51, . . . aligned in a plurality of rows and a plurality of columns at substantially equal intervals at positions close to the center except the vicinity of an outer edge of the base plate 5, and the second holes 52, . . . disposed at substantially equal intervals along an outer peripheral line in the vicinity of the outer edge of the base plate 5, as illustrated in FIG. 2. These first holes 51 and second holes 52 are formed by embedding a metal component having female screw threaded thereon into a body of the base plate 5. The ball roller members 61 to 63 threadedly engage with the first holes 51, and the brake members 71 to 73 threadedly engage with the second holes 52.

As illustrated in FIG. 1 to FIG. 3, the ball roller members 61 to 63 are disposed in the first holes 51 selected from among the plurality of first holes 51, . . . , in accordance with the preference of a user, or in accordance with application of a sport. For example, in FIG. 1, the four ball roller members 61, 61, 61, 61 are disposed at apexes of a rhombus in a front part (front treading) of a foot, the four ball roller members 61, 61, 62, 62 are disposed at apexes of a rhombus in a rear part (rear treading) of the foot, and the two ball roller members 63, 63 are further disposed on the left and the right of the arch of the foot.

The ball roller member 61 (62, 63) of this embodiment is selectable from among the ball roller members 61 to 63 having a plurality of outer diameters, as illustrated in FIGS. 4(*a*) to 4(*c*). For example, three kinds of ball roller members 61, 62, 63 having different outer diameters can be prepared. In this case, assuming that the outer diameter of the large-size ball roller member 61 is 1, the outer diameter of the medium-size ball roller member 62 can be set to 0.8, and the outer diameter of the small-size ball roller member 63 can be set to 0.6. Furthermore, although not illustrated, the ball roller member 61 (62, 63) of this embodiment can be selected from among ball roller members 61 (62, 63) having a plurality of kinds of coefficients of friction. Consequently, the outer diameters (three kinds) and the coefficients of friction (three kinds) are combined, so that the suitable ball roller member 61 (62, 63) can be selected from among the nine kinds of the ball roller members 61 (62, 63).

Each ball roller member 61 (62, 63) can rotate in any direction by 360 degrees by rotation of a ball d. More specifically, as illustrated in FIG. 4(*a*), each ball roller member 61 (62, 63) is composed of a mounting part a, a holding part b, a plurality of bearings c, . . . , the ball d formed by covering a sphere made of synthetic resin or made of metal with synthetic resin or synthetic rubber, a spring part e as impact absorbing means, and a male screw f threadedly carved on an outer periphery of the mounting part a. Therefore, the male screw f of the mounting part a is threadedly engaged with the female screw of each first hole 51, so that the ball roller member 61 can be fixed to the base plate 5. The spring part e is a plate spring formed by bending metal, and urges the whole of the bearings c and the ball d in the direction of the holding part b from the mounting part a.

As illustrated in FIG. 1 to FIG. 3, the brake members 71 to 73 are disposed in the second holes 52 selected from among the plurality of second holes 52, . . . , in accordance with the preference of a user, or in accordance with application of a sport. For example, in FIG. 1, the five brake members 71, 72, 72, 71, 71 are disposed at apexes of a pentagon in the front part (front treading) of the foot, and the three brake members 71, 73, 73 are disposed at apexes of a triangle in the rear part (rear treading) of the foot.

The brake member 71 (72, 73) of this embodiment is selectable from among brake members 71 to 73 having a plurality of sizes, as illustrated in FIGS. 5(*a*) to 5(*c*). For example, three kinds of the brake members 71, 72, 73 having different sizes can be prepared. In this case, assuming that the height of the large-size brake member 71 is 1, the height of the medium-size brake member 72 can be set to 0.8, and the height of the small-size brake member 73 can be set to 0.6.

In each brake member 71 (72, 73), a hexagonal columnar body part b formed of a raw material such as synthetic resin and synthetic rubber is grounded to generate friction. That is, the height of each brake member 71 (72, 73) is made equal to or lower than the height of the largest ball roller member 61 to be used, and the skating shoe 1 is inclined to the right and left or forward and rearward, so that the brake member 71 (72, 73) is grounded. More specifically, as illustrated in FIG. 5 (*a*), the brake member 71 (72, 73) is composed of a mounting part a, a body part b, and a male screw c threadedly carved on an outer periphery of the mounting part a. Therefore, the male screw c of the mounting part a is threadedly engaged with the female screw of each second hole 52, so that the brake member 71 can be fixed to the base plate 5. The shape of each brake member 71 (72, 73) can be designed in accordance with the use, and for example, may be a polygonal prism such as a triangular prism and a quadrangular prism, a circular column, or the like.

(Action and Effects)

Now, action and effects produced by the skating shoe 1 including the ball skate sole structure 4 of this embodiment will be described.

(1) As described above, the ball skate sole structure 4 of this embodiment includes the base plate 5 having the plurality of first holes 51, . . . , and the plurality of second holes 52, . . . , the at least one ball roller member 61 (62, 63), the at least one ball roller member 61 (62, 63) being disposed in the first hole 51 selected from among the plurality of first holes 51, . . . ; and the at least one brake member 71 (72, 73), the at least one brake member 71 (72, 73) being disposed in the second hole 52 selected from among the plurality of second holes 52, . . . . With such a configuration, arrangement of the ball roller members 61 (62, 63) and the brake members 71 (72, 73) are suitably selected, so that the ball skate sole structure can be customized for each individual (each body type or in accordance with preference) or for each sport. Furthermore, even when replacement is needed by malfunction, abrasion, or the like, it is possible to easily replace the ball roller member 61 (62, 63) or the brake member 71 (72, 73).

Combination of the arrangement of the ball roller members 61 (62, 63) and the brake members 71 (72, 73) enabling sliding not only in the one direction but also in the multiple directions is changed, so that the ball skate sole structure can correspond to most movement and preference. For example, it is possible to obtain a configuration enabling easy movement to the right and the left, or a configuration enabling easy movement forward and rearward. Furthermore, in a sport such as hockey, as illustrated in FIG. 6(*a*), a large number of the ball roller members 61 (62, 63) can be disposed for an offensive player, and as illustrated in FIG. 6(*b*), a large number of the brake members 71 (72, 73) can be disposed for a defensive player.

(2) The ball roller member 61 (62, 63) can be selected from among the ball roller members 61 to 63 having a plurality of outer diameters, and therefore the ball skate sole structure can be customized in accordance with riding comfort for each individual (for each body type), or customized in accordance with use for each sport. For example, when the ball roller member 63 is disposed in the vicinity of the arch of the foot, sliding by being caught on a pipe for a handrail can be performed. Furthermore, the ball roller member is combined with the brake member 71 (72, 73), so that the arrangement enabling easy movement to the right and the left, or the arrangement enabling easy movement forward and rearward is possible.

(3) The brake member 71 (72, 73) can be selected from among the brake members 71 to 73 having a plurality of sizes and/or shapes, and therefore the ball skate sole structure can be customized in accordance with riding comfort for each individual (for each body type), or customized in accordance with use for each sport. For example, in a case of the sport such as hockey, a large number of the large brake members 71 (72, 73) can be disposed for a defensive player, and a small number of the brake members 73 (71, 72) can be disposed for an offensive player. Furthermore, the brake member is combined with the ball roller member 61 (62, 63), so that the arrangement enabling easy movement to the right and the left, or the arrangement enabling easy movement forward and rearward is possible.

(4) The ball roller member 61 (62, 63) can be selected from among the ball roller members 61 to 63 having a plurality of kinds of the coefficients of friction, and therefore the ball skate sole structure can be customized in accordance with riding comfort for each individual (for each body type), or customized in accordance with use for each sport. For example, in a case of the sport such as hockey, the ball roller member 61 (62, 63) having a large coefficient of friction can be disposed for a defensive player, and the ball roller member 71 (72, 73) having a small coefficient of friction can be disposed for an offensive player.

(5) The above skating shoe 1 including the ball skate sole structure 4, and the upper part 10 that stores a foot can become the skating shoe 1 capable of being customized in accordance with riding comfort for each individual (each body type), or in accordance with use for each sport.

Embodiment 2

Hereinafter, a sandal structure 2 including a ball skate sole structure 4 of the present invention will be described with reference to FIG. 7. Parts identical or equal to the contents described in the above embodiment are denoted by the same reference numerals to be described.

As illustrated in FIG. 7, the sandal structure 2 is mainly composed of the ball skate sole structure 4, and an engaging means 20 for engaging a shoe. The ball skate sole structure 4 includes ball roller members 61 (62, 63) and brake members 71 (72, 73) that can be disposed by selecting positions from a plurality of holes 51, 52, . . . of a base plate 5. That is, a user can enjoy ball skating by engaging shoes with the sandal structures 2 in a state of wearing the shoes.

The sandal structure 2 has such a configuration, and therefore the sandal structure 2 can be customized for each individual (each body type) or each sport. Furthermore, even when replacement is needed by malfunction, abrasion, or the like, it is possible to easily replace the ball roller member 61 (62, 63) or the brake member 71 (72, 73).

Configurations, action and effects other than the above are substantially similar to those of the above embodiment, and therefore description thereof will be omitted.

Embodiment 3

Hereinafter, a skateboard 3 including a ball skate sole structure 4 of the present invention will be described with reference to FIG. 8. Parts identical or equal to the contents described in the above embodiments are denoted by the same reference numerals to be described.

As illustrated in FIG. 8, the skateboard 3 includes a base plate 5 of the ball skate sole structure 4 as a deck part 30. The ball skate sole structure 4 includes ball roller members 6 and brake members 7 that can be disposed by selecting positions from a plurality of holes 51, 52, . . . of the base plate 5. Therefore, a user can enjoy the skateboard 3 by riding on the skateboard 3 in a state of wearing shoes.

The skateboard 3 has such a configuration, and therefore the skateboard 3 can be customized for each individual (each body type) or each sport. Furthermore, even when replacement is needed by malfunction, abrasion, or the like, it is possible to easily replace the ball roller member 6 or the brake member 7.

Configurations, action and effects other than the above are substantially similar to those of the above embodiments, and therefore description thereof will be omitted.

Embodiment 4

Hereinafter, a ball skate sole structure (4) of another form will be described with reference to FIG. 9 and FIG. 10. Parts identical or equal to the contents described in the above embodiments are denoted by the same reference numerals to be described.

As illustrated in FIG. 9, ball roller members 61 to 63 of this embodiment have respective mounting parts a whose diameter are different from each other. The outer diameter of a mounting part a1 of the ball roller member 61 having a large ball d is large, the outer diameter of a mounting part a3 of the ball roller member 63 having a small ball d is small, and the outer diameter of a mounting part a2 of the ball roller member 62 having a medium ball d is medium. Similarly, in brake members 71 to 73 of this embodiment, the outer diameter of a mounting part a1 of the brake member 71 having a large body part b is large, the outer diameter of a mounting part a3 of the brake member 73 having a small body part b is small, and the outer diameter of a mounting part a2 of the brake member 72 having a medium body part b is medium.

First holes 51 of a base plate 5 of this embodiment correspond to the diameters of the mounting parts a1 to a3 of the ball roller members 61 to 63, and have three kinds of inner diameters which are composed of large-diameter first holes 511, small-diameter first holes 513, and medium-diameter first holes 512. Similarly, the second holes 52 correspond to the diameters of the mounting parts a1 to a3 of the brake members 71 to 73, and have three kinds of inner diameters which are composed of large-diameters second holes 521, small-diameter second holes 523, and medium-diameter second holes 522. Thus, each of the first holes 511 to 513 and the second holes 521 to 523 have the respective three kinds of inner diameters so as to correspond to the outer diameters of the mounting parts a1 to a3 of the ball roller members 61 to 63 and the outer diameters of the mounting parts a1 to a3 of the brake members 71 to 73, so that it is possible to apply a certain regulation while allowing a certain degree of freedom of the arrangement of the ball roller members 61 to 63 and the arrangement of the brake members 71 to 73.

Configurations, action and effects other than the above are substantially similar to those of the above embodiments, and therefore description thereof will be omitted.

Embodiment 5

Hereinafter, another form of the base plate 5 of the ball skate sole structure 4 of the present invention will be described with reference to FIGS. 11(*a*) and 11(*b*). Parts identical or equal to the contents described in the above embodiments are denoted by the same reference numerals to be described.

As illustrated in FIGS. 11(*a*) and 11(*b*), a base plate 5 of this embodiment is configured by integrally including hard members 50H relatively harder than soft members 50S, and the soft members 50S relatively softer than the hard members 50H. The hard members 50H are each constituted of metal such as iron, hard synthetic resin, synthetic rubber, a carbon fiber, or a ceramic to be formed in a plate shape, and first holes 51 and second holes 52 are disposed. On the other hand, the soft members 50S are each constituted of a raw material having elasticity including synthetic rubber, and any first hole 51 and any second hole 52 are not disposed. In this embodiment, the first holes 51 and the second holes 52 have the same diameter, and can be used for a double purpose.

In FIG. 11(*a*), the soft members 50S are each disposed in a belt-like shape on the right-and-left direction of a foot, the hard members 50H are each disposed in a belt-like shape on the right-and-left direction of the foot. Furthermore, the width of each soft member 50S in the fore-and-aft direction of the foot is narrower than the width of each hard member 50H. On the other hand, in FIG. 11(*b*), the soft members 50S are disposed so as to intersect in the right-and-left direction and the fore-and-aft direction of the foot, so that the hard members 50H are each disposed in an island shape.

The base plate 5 has such a configuration, so that the base plate 5 is bent to the front and rear, to the right and left, and therefore it is possible to provide a skating shoe 1 or a sandal 2 allowing easy movement and imposing little burden on a foot. That is, portions of the soft member 50S are soft, and can be freely bent, and therefore portions of the hard member 50H are hard to be unlikely to be bent, but the whole of the base plate 5 allows deformation to a certain degree.

Configurations, action and effects other than the above are substantially similar to those of the above embodiments, and therefore description thereof will be omitted.

Embodiment 6

Hereinafter, a skating shoe 1 and a skateboard 3 each including a ball skate sole structure 4 of another form will be described with reference to FIG. 12 and FIG. 13. Parts identical or equal to the contents described in the above embodiments are denoted by the same reference numerals to be described. Herein, a sandal is not particularly described, but the following invention can be also applied to the sandal.

As illustrated in FIG. 12, the skating shoe 1 including the ball skate sole structure 4 of this embodiment includes a base plate 5, at least one of ball roller members 61 to 63, and at least one of brake members 71 to 73. The ball skate sole structure 4 further includes an upper plate 8 disposed so as to overlap on the base plate 5 with a predetermined distance, and at least one spring 9 as an elastic member disposed between the base plate 5 and the upper plate 8. In addition to this, the ball skate sole structure 4 preferably has a coupling structure of coupling the upper plate 8 and the base plate 5 while allowing a predetermined play (movement in the front, rear, right and left directions, and movement in the vertical direction).

As the elastic member, in addition to the spring (a coiled spring or a plate spring) 9, a damper member using air pressure, gas pressure, or oil pressure may be used, and a composite construction obtained by combination of the spring and the damper member, or a synthetic rubber piece, a natural rubber piece, a synthetic resin piece, or the like having a plate shape can be used. Furthermore, a plurality of kinds of springs 9 (for example, each three kinds, and a total of eighty-one kinds) having different heights, different diameters, different materials, and the different numbers of turns are preferably prepared to be selectable in accordance with use or preference (this applies to the following FIG. 13). Of course, arrangement positions of the springs 9 are preferably freely selectable (this applies to the following FIG. 13).

Similarly, as illustrated in FIG. 13, the skateboard 3 including the ball skate sole structure 4 of this embodiment includes a base plate 5 as a deck part, and ball roller members 6 and brake members 7 that can be disposed by selecting positions from a plurality of holes of the base plate 5. The ball skate sole structure 4 further includes an upper plate 8 disposed so as to overlap on the base plate 5 with a predetermined distance, and at least one spring 9 as an elastic member disposed between the base plate 5 and the upper plate 8.

With such a configuration, a satisfactory skating shoe 1 or a satisfactory skateboard 3 that reduces burden on a foot, and provides riding comfort is obtained. That is, the elastic member is interposed, so that impact from the ground can be absorbed, and the upper plate 8 is inclined, so that the weight can be smoothly moved.

Configurations, action and effects other than the above are substantially similar to those of the above embodiments, and therefore description thereof will be omitted.

While the embodiments of the present invention are thus described in detail with reference to the drawings, a specific configuration is not limited to these embodiments, change in design without departing from the scope of the present invention is included in the present invention.

For example, in Embodiments 1 to 3, the first holes and the second holes are different systems. However, the present invention is not limited to this, and the first holes and the second holes may be the completely equal same system. With such a configuration, it is possible to further enhance the degree of freedom of the arrangement of the ball roller members and the brake members.

In Embodiment 1, the spring part e is described as the impact absorbing means. However, the present invention is not limited to this, and the impact absorbing means may be a coiled spring, or may be a damper member using air pressure or oil pressure. Furthermore, as the impact absorbing means, a plate member constituted of synthetic rubber or natural rubber can be disposed on the base plate 5.

Furthermore, while the embodiments are not particularly described, a left skating shoe 1 and a right skating shoe 1 may not be symmetrical, and the arrangement of the ball roller member or the brake member on the right and the left can be changed. With such a configuration, for example, the present invention can be used for training of curling

REFERENCE SIGNS LIST

1 skating shoe
10 upper part
2 sandal structure
20 engaging means
3 skateboard
30 deck part
4 ball skate sole structure
5 base plate
51 first hole
52 second hole
61, 62, 63 ball roller member
71, 72, 73 brake member

What is claimed is:

1. A ball skate sole structure comprising:

a base plate including a plurality of first holes extending into the base plate and a plurality of second holes extending into the base plate;

at least one ball roller, the at least one ball roller being disposed in a first hole selected from among the plurality of first holes; and at least one brake, the at least one brake being disposed in a second hole selected from among the plurality of second holes.

2. The ball skate sole structure according to claim 1, wherein the base plate has the plurality of first holes disposed in a plurality of rows and a plurality of columns, and the plurality of second holes disposed along an outer peripheral line.

3. The ball skate sole structure according to claim 1, wherein the at least one ball roller is selectable from among ball rollers having a plurality of outer diameters.

4. The ball skate sole structure according to claim 1, wherein the at least one brake is selectable from among brakes having a plurality of sizes and/or shapes.

5. The ball skate sole structure according to claim 1, wherein the at least one ball roller is selectable from among ball rollers having a plurality of kinds of coefficients of friction.

6. The ball skate sole structure according to claim 1, wherein the base plate is integrally composed of a hard material that is provided with the plurality of first holes and the plurality of second holes, and a soft material that is not provided with the plurality of first holes and the plurality of second holes.

7. The ball skate sole structure according to claim 1, further comprising:

an upper plate disposed to overlap with the base plate; and at least one elastic impact absorber is disposed between the base plate and the upper plate.

8. A skating shoe comprising:

the ball skate sole structure according to claim 1; and an upper body that stores a foot.

9. A sandal structure comprising:

the ball skate sole structure according to claim 1; and an engaging attachment to secure to a shoe.

10. A skateboard comprising:

the ball skate sole structure according to claim 1, which is structured as a deck of the skateboard.

11. The ball skate sole structure according to claim 1, wherein the at least one ball roller is removably affixed to the base plate at a surface of the first hole, and the at least one brake is removably affixed to the base plate at a surface of the second hole.

12. The ball skate sole structure according to claim 1, wherein the at least one ball roller is threadedly engaged with the base plate at one or more threads in the first hole, and the at least one brake is threadedly engaged with the base plate at one or more threads in the second hole.

13. The ball skate sole structure according to claim 1, wherein the at least one ball roller and the at least one brake are nonoverlapping with one another in a plan view of a bottom of the base plate.

14. The ball skate sole structure according to claim 1, further comprising:

more than one of the ball roller, each being disposable in any of the plurality of first holes; and more than one of the brake, each being disposable in any of the plurality of second holes.

15. The ball skate sole structure according to claim 1, wherein the at least one ball roller includes a threaded mount, a holder, and a ball, the threaded mount is connected to the holder, and the threaded mount is threadedly engaged with one or more threads in the first hole of the base plate, and the holder partially houses the ball.

16. The ball skate sole structure according to claim 15, wherein the at least one ball roller includes at least one bearing and an impact absorber that are housed in the holder.

17. The ball skate sole structure according to claim 1, wherein the at least one brake includes a threaded mount and a brake body, and the threaded mount is connected to the brake body, and the threaded mount is threadedly engaged with one or more threads in the second hole of the base plate.

18. The ball skate sole structure according to claim 1, wherein the at least one brake is not disposed in a same hole with any ball roller.

19. The ball skate sole structure according to claim 1, wherein each of the plurality of first holes extending into the base plate is configured to receive only a ball roller that is among the at least one ball roller, and each of the plurality of second holes extending into the base plate is configured to receive only a brake that is among the at least one brake.

* * * * *